US007098764B2

(12) United States Patent
Schaumburg et al.

(10) Patent No.: US 7,098,764 B2
(45) Date of Patent: Aug. 29, 2006

(54) MAIN CONDUCTOR FOR A CAPACITIVELY CONTROLLED HIGH-VOLTAGE WINDING

(75) Inventors: Wilhelm Schaumburg, Bad Arolsen (DE); Joachim Runge, Bad Arolsen (DE)

(73) Assignee: Nexans, (FR)

( * ) Notice: Subject to any disclaimer, the term of this patent is extended or adjusted under 35 U.S.C. 154(b) by 0 days.

(21) Appl. No.: 11/077,988

(22) Filed: Mar. 11, 2005

(65) Prior Publication Data

US 2005/0206489 A1 Sep. 22, 2005

(30) Foreign Application Priority Data

Mar. 18, 2004 (DE) ..... 10 2004 013 416

(51) Int. Cl.
*H01F 27/28* (2006.01)

(52) U.S. Cl. ..... 336/69; 336/182; 336/183; 336/209

(58) Field of Classification Search ..... 336/69, 336/70, 182–187, 199, 206, 209
See application file for complete search history.

(56) References Cited

U.S. PATENT DOCUMENTS 4,797,509 A * 1/1989 Cook ..... 174/84 C
5,209,973 A * 5/1993 Wille et al. ..... 428/352
5,600,294 A * 2/1997 Buenconsejo et al. ..... 336/192

FOREIGN PATENT DOCUMENTS

WO WO00/77800 A1 * 12/2000

* cited by examiner

*Primary Examiner*—Ramon M. Barrera
(74) *Attorney, Agent, or Firm*—Sofer & Haroun, LLP

(57) ABSTRACT

In a main conductor for a capacitively controlled high-voltage winding composed of pancake coils for transformers, in which the main conductor for the load current is realized as a twisted conductor, and in which a control conductor is provided which is spatially arranged inside the twisted conductor and is electrically separated from the twisted conductor, the main conductor consists of two twisted conductors (1, 2) that are electrically separated from each other. The control conductor consists of several flat copper conductors (7) covered by an insulating sheath (7*a*), and the copper conductors (7) are fastened to one of the twisted conductors (1, 2).

9 Claims, 1 Drawing Sheet

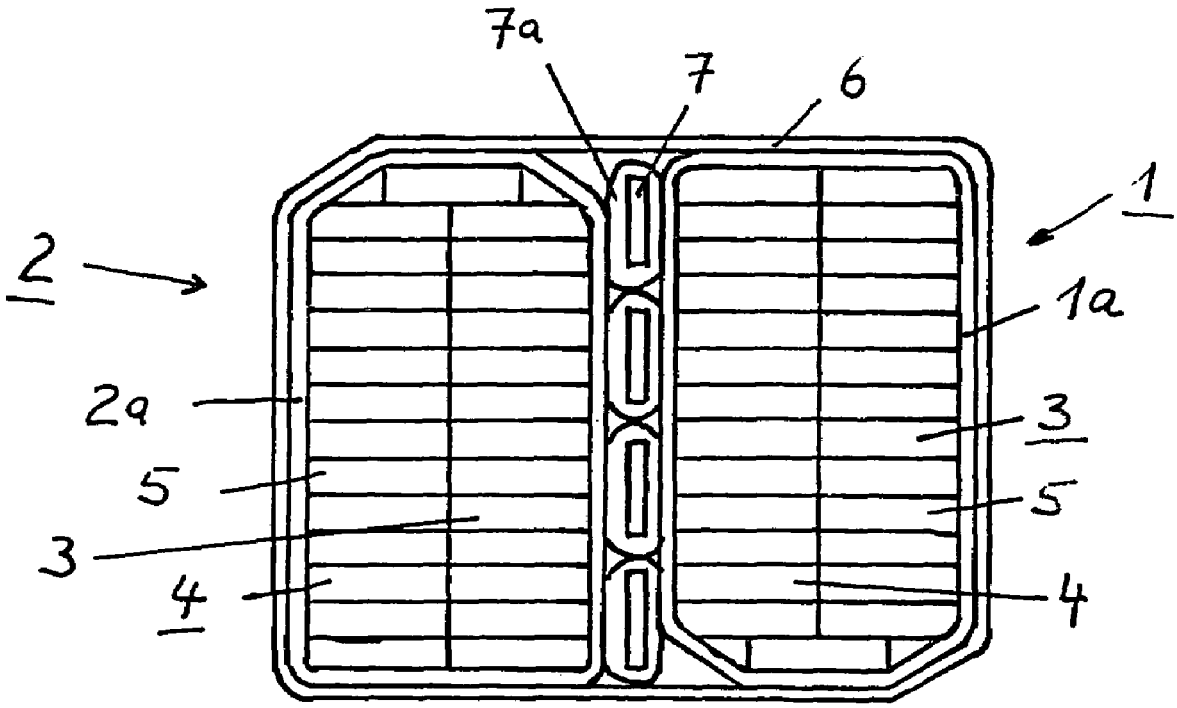
7a
7
6
1
2
1a
2a
3
5
5
3
4
4

MAIN CONDUCTOR FOR A CAPACITIVELY CONTROLLED HIGH-VOLTAGE WINDING

RELATED APPLICATION

This application is a related to and claims the benefit of priority to German Patent Application No. 10 2004 013 416.2, filed on Mar. 18, 2004, the entirety of which is incorporated herein by reference.

FIELD OF THE INVENTION

The invention concerns a main conductor for a capacitively controlled high-voltage winding and a method for producing a main conductor for a capacitively controlled high-voltage winding.

BACKGROUND

DE 199 26 540 C1 describes a high-voltage winding in which the coil windings are produced from so-called twisted conductors. The supplementary losses caused by the stray field are reduced by the use of twisted conductors. Furthermore, the available winding space can be better utilized by a higher space factor.

The production of interwound coils always requires soldered connections, which can be realized only with great difficulty or not all when twisted conductors are used. Therefore, when twisted conductors are used, to avoid soldered connections, a continuously windable double-coil connection is to be strived for, in which the capacitive control can also be achieved by a special control conductor, whose soldered connections can be produced simply and economically.

In DE 199 26 540, the control conductor is spatially arranged inside the main conductor and is electrically separated from the main conductor. The control conductor is arranged between two stacks of individual conductors; the individual conductors lie flat one above the other and together form the main conductor. To achieve electrical separation of the control conductor from the main conductor, either the control conductor has insulation, or the space between the control conductor and the main conductor is filled by a filler or by an intermediate layer of insulation material.

Due to the arrangement of the control conductor between the two stacks of individual conductors, there is the danger that the control conductor will be displaced during the further processing of the twisted conductor, e.g., during the production of a transformer winding, and that this can destroy the insulation of the control conductor or of the individual conductors of the twisted conductor. Furthermore, during the production of the winding, there is the danger that the necessary geometrically correct arrangement of the individual layers of a winding is no longer guaranteed.

SUMMARY

The goal of the present invention is to develop a main conductor with a control conductor, in which damage of the insulation of both the control conductor and the twisted conductor is avoided. In addition, the behavior of the main conductor during the process of winding the transformer winding is to be improved.

The use of two twisted conductors and the arrangement of the control conductor between the twisted conductors guarantees that no changes whatsoever must be made during the usual Roebel process. The fixation fastening of the control conductor inside the main conductor between the two twisted conductors ensures that the control conductor can no longer move.

BRIEF DESCRIPTION OF THE DRAWINGS

The invention is explained in greater detail with reference to the embodiment schematically illustrated in the drawing wherein FIG. 1 illustrates a main conductor for a capacity controlled high voltage winding, in accordance with one embodiment of the present invention.

DETAILED DESCRIPTION

The drawing shows a main conductor for a capacitively controlled high-voltage winding. The main conductor is composed of two twisted conductors 1 and 2. Each twisted conductor has a large number of rectangular individual conductors 5 located in two stacks 3, 4 that are arranged side by side. In the production of the twisted conductors 1 and 2, the uppermost and lowermost conductors 5 each changes over from the adjacent stacks 3 and 4 into the other stack 3 and 4, such that the conductors 5 are each offset by half a pitch. This results in a constant overall height in the case of odd-numbered twisted conductors.

Each twisted conductor 1 and 2 has an insulating sheath 1*a* and 2*a*, which is preferably a paper covering.

The two twisted conductors 1 and 2 that form the main conductor are surrounded by a sheath 6 of crepe paper. For reasons of strength, microcreped and calendered insulating paper is used as the crepe paper.

Several control conductors 7 made of flat-bar copper are arranged between the twisted conductors 1 and 2. Each control conductor has its own paper insulating sheath 7*a*. The control conductors are connected with one of the twisted conductors 1 or 2. The connection is created either by spot or full-surface adhesion with a curable adhesive and/or by wrapping with one or more layers of paper.

To produce the illustrated main conductor, the two twisted conductors 1 and 2 are first produced.

In the next step of the process, the twisted conductors 1 and 2 are brought together, the control conductors 7 are arranged between the twisted conductors 1 and 2, and the two twisted conductors 1 and 2 are wrapped with one or more layers of paper. For reasons of strength, microcreped and calendered paper is used for the wrapping 6. The control conductors 7 can be fastened to one of the twisted conductors 1, 2 by adhesive bonding before or at the same time the twisted conductors 1 and 2 are brought together.

What is claimed is:

1. Main conductor for a capacitively controlled high-voltage winding comprising:

pancake coils for transformers, in which a main conductor for a load current is realized as a continuously transposed conductor, and in which a control conductor is provided which is spatially arranged inside said continuously transposed conductor and is electrically separated from said continuously transposed conductor, wherein said main conductor has two continuously transposed conductors that are electrically separated from each other, that said control conductor has several flat copper conductors covered by an insulating sheath, and that said copper conductors are fastened to one of said continuously transposed conductors.

2. Main conductor in accordance with claim 1, wherein said copper conductors are adhesively bonded with the lateral surface of one of said continuously transposed conductors.

3. Main conductor in accordance with claim 2, wherein said copper conductors are adhesively bonded with said continuously transposed conductor with an adhesive-coated paper tape.

4. Main conductor in accordance with claim 2, wherein said copper conductors are bonded with the continuously transposed conductor by a curable adhesive that is applied in the liquid state.

5. Main conductor in accordance with claim 1, wherein said insulating sheath of said copper conductors is made of paper.

6. Main conductor for a capacitively controlled high-voltage winding comprising:

pancake coils for transformers, in which a main conductor for a load current is realized as a continuously transposed conductor, and in which a control conductor is provided which is spatially arranged inside said continuously transposed conductor and is electrically separated from said continuously transposed conductor, wherein said main conductor has two continuously transposed conductors that are electrically separated from each other, that said control conductor has several flat copper conductors covered by an insulating sheath, and that said main conductor, which has said two continuously transposed conductors and said control conductor has a wrapping made of microcreped and calendered insulating paper.

7. Method for producing a main conductor for a capacitively controlled high-voltage winding, said main conductor having pancake coils for transformers, said method comprising the steps of:

producing a first a first twisted conductor that has two stacks of individual conductors;

producing a second twisted conductor that has two stacks of individual conductors; and bringing together said two twisted conductors, wherein a copper conductor or conductors are arranged between said two twisted conductors, and that said two twisted conductors with said copper conductor located between them are provided with a wrapping of microcreped and calendered paper tape.

8. Method in accordance with claim 7, wherein several copper conductors spaced some distance apart are arranged between said twisted conductors.

9. Method in accordance with claim 7, wherein said copper conductors are adhesively bonded with the lateral surface of said twisted conductor.

* * * * *